United States Patent [19]

Davis et al.

[11] Patent Number: 4,995,616

[45] Date of Patent: Feb. 26, 1991

[54] OPTICAL TRANSCEIVER SYSTEM

[76] Inventors: Dennis W. Davis, 10740 Eland St., Boca Raton, Fla. 33428; Russell D. Davis, 8905 NW. 28th Dr., Apt. A, Coral Springs, Fla. 33065

[21] Appl. No.: 468,686

[22] Filed: Jan. 23, 1990

[51] Int. Cl.[5] ..... F41J 5/08

[52] U.S. Cl. ..... 273/312; 273/1 GA; 273/358

[58] Field of Search ..... 273/310–312, 273/1 GA, 358; 434/22, 21

[56] References Cited

U.S. PATENT DOCUMENTS

| | | | |
|---|---|---|---|
| 3,499,650 | 3/1970 | Lemelson | 273/310 |
| 4,137,651 | 2/1979 | Pardes et al. | 273/312 |
| 4,322,080 | 3/1982 | Pennington | 273/311 |

FOREIGN PATENT DOCUMENTS

| | | | |
|---|---|---|---|
| 2337872 | 8/1977 | France | 273/312 |

*Primary Examiner*—Benjamin Layno

[57] ABSTRACT

A light projection tag system provides for the detection of spatially coincident light patterns projected by competing players on a gaming surface. Each player is equipped with an optical transceiver with a field-of-view that is geometrically coincident with the light pattern projected from the transceiver. Each player's transceiver can detect when an opponent's light pattern, also projected on the gaming surface, enters this field-of-view thereby achieving a tag. Detection methods include the use of modulated visible or infrared light. Various embodiments of the system include automatic targets and projected gaming mazes.

15 Claims, 7 Drawing Sheets

OPTICAL TRANSCEIVER SYSTEM

BACKGROUND OF THE INVENTION

A system is disclosed in U.S. Pat. No. 4,322,080 entitled Image Projecting Amusement Device, issued to H. Pennington, wherein the image of an obstacle course and moving target are independently projected on a screen. The moving target image is projected by a player controlled assembly in order to superpose the image of an obstacle course projected by a stationary projector. Optical means are provided for the detection of the overlap of the target and obstacles.

The system described by Pennington achieves obstacle detection by observing the intensity of light reflected from the screen along an optical axis which intercepts the image of the projected target at the screen. The target projector and optical receiver are co-mounted in a fixed relationship on a player controlled pointing assembly so that their respective optical axes intersect at the screen location of the projected target image. Variations in light intensity are detected by the receiver if images of obstacles are superposed by the player controlled target image (the target has "contacted" an obstacle). Because "contact" of a target with an obstacle is sensed by detecting variation in light intensity the projection must occur on a flat, uniform reflectivity surface. This system operates at fixed range and confines the area of play to the screen region.

A markmanship system which provides for the coprojection of visible and infrared light is disclosed by Pardes in U.S. Pat. No. 4,349,337. The system describes a projector for the coprojection of a visible and infrared image which are coincident on a target screen. A pair of infrared detectors are mounted on a separate device simulating a weapon. When this aiming device is pointed at the projected target image a simulated hit is detected. One of the infrared detectors is boresighted with the pointing direction of the aiming device to detect the infrared target image that is present at the location of the visible target image. The other detector is mounted just off this axis and receives light from the scene adjacent to the target image so as to provide a background light reference level. As such the system makes use of unmodulated infrared light in much the same way as the invention to Pennington uses visible light, to detect changes in received light intensity when the image to be detected moves into the receiver field-of-view. The system disclosed by Pardes operates at fixed range subject to the requirement of a uniform projection screen as well.

An earlier patent issued to Pardes, U.S. Pat. No. 4,170,077, describes a markmanship system in which the target projector includes coprojection of visible and modulated infrared light with a receiver which detects the presence of modulated infrared light within its field-of-view. This modulation is achieved by mechanical motion of a grid structure which limits the modulation rate.

The Panosh Group Inc. of Cherry Hill, N.J. recently introduced a toy called "Laser Combat" which comprises a gun and moving reflective target. The gun projects light from an electrically modulated incandescent bulb along a first optical axis and receives retroreflected light from the target along an axis adjacent and parallel to the first. The limited modulation rate requires that the gun dwell on the target at least a tenth of a second for reliable detection of return light.

A game device disclosed in U.S. Pat. No. 4,799,687 entitled Projected Image Tag Game issued to Davis et al comprises an optical transceiver which transmits both visible and infrared light. The function of a given device is to detect the superposition of images projected on arbitrary surfaces by the given device and other such devices. Within a transceiver the source of modulated infrared light and the means for its detection are collocated and are in fact the same device, a light emitting diode which is functionally time division multiplexed. The use of the light emitting diode as a detector significantly limits the range of the transceiver.

SUMMARY OF THE INVENTION

This invention provides a light projection tag system of the type described initially, comprising individual transceiver devices which project visible images. Use of this system makes possible player aim improvement and the high speed game action associated with video arcades but with minimal constraint placed on the type or size of the playing space. The portability of the system allows it to be used indoors or outside. The transceiver devices can score and annunciate game points.

According to one of two chief device embodiments of the present invention, players each use a handheld optical transceiver which has a narrow receiver field of view that is coincident with the field of visible light which the transceiver projects to form an image on a gaming surface. The projected visible light is modulated at a frequency characteristic of a given transceiver. Detection of the characteristically modulated visible light which is reflected from the gaming surface and enters the field of view of the receiver indicates an opponent image has overlapped the initial image (i.e., a tag has occurred).

A second embodiment includes in each transceiver a source of unmodulated visible light and a source of infrared light modulated at a frequency characteristic of the given transceiver. These infrared and visible light beams are co-projected along the same path to the gaming surface. In lieu of a visible light detector, the receiver portion of each transceiver uses an infrared detector.

A basic feature of either of the aforementioned embodiments is robust operation with arbitrary non-specular gaming surfaces in the presence of room lighting, outdoor lighting or other noise sources. Non-specular gaming surfaces include just about any surface other than water, glass, highly polished metal or plastics; for instance, appropriate surfaces include interior or exterior walls of houses and buildings, the ground, whether sodded or not, and even shrubbery or trees.

A further variation of the disclosed system of transceivers includes means for projecting automatic targets. This is accomplished by a transceiver which has a mechanically or electro-mechanically controlled beam steering mirror. The control of this mirror induces random translation of target image and/or images across the playing surface. These images can be caused to blink on and off as well.

A gaming maze embodiment makes use of a transceiver which can project target images in the form of mazes. A slide projector version can use any of a large number of maze slides. The objective of this game version would be time-limited transit of the maze or chase of an opponent through the maze without player image overlap with the maze boundaries.

The most basic version of the invention disclosed uses small, handheld flashlight transceiver units with contained scoring means. With only incremental cost, the more elaborate embodiments can add automated targets or microprocessor control to the game.

Versions of this invention are explained in detail below with reference to the figures.

DETAILED DESCRIPTION OF THE INVENTION

Figure 1:
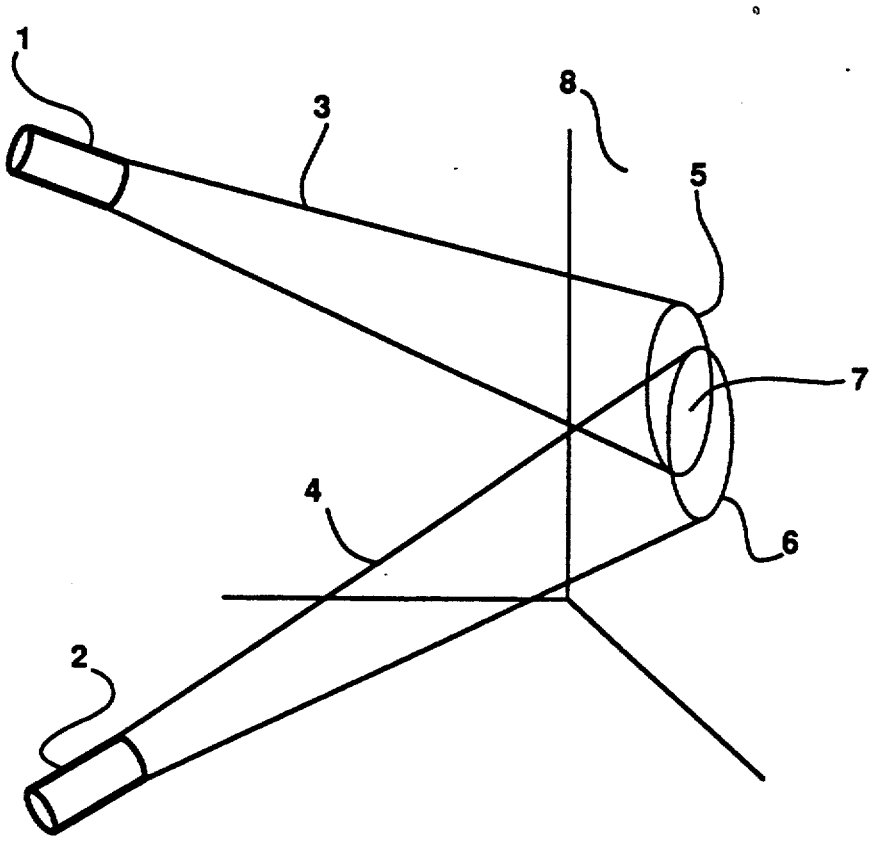
FIG. 1 is a pictorial of the general system concept.

FIG. 1 illustrates the present concept of a system of transceivers which project visible light patterns and detect their overlap on distant surfaces. Handheld versions of such optical transceivers 1 and 2 are nominally a few inches in diameter and several inches long. Each transceiver projects light along the respective beam paths 3 or 4 to form a light pattern 5 or 6 on a distant surface 8. The transceivers are capable of detecting the occurence of an overlap region 7 for the patterns 5 and 6. In a game application such image region overlap 7 constitutes a "tag" and the light pattern from each transceiver could be a different color or shape for ease of distinguishing the identity of projected patterns.

The optical transceiver can be reduced to practice in either of two major embodiments. The first of these exploits detection of modulation of visible light; a second approach involves auxiliary projection and detection of modulated infrared light with projected visible light serving solely as a visual cue to the user. Each of these transceiver approaches is implemented in a device having two optical apertures.

Figure 2:
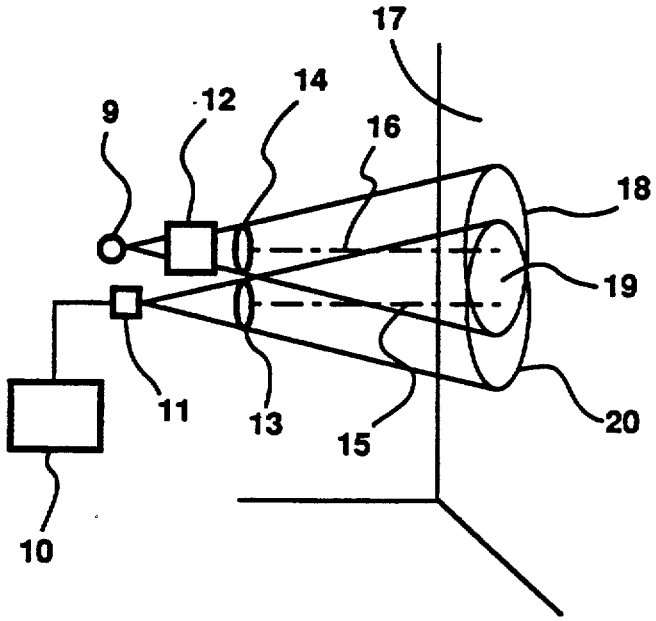
FIG. 2 is an embodiment of a transceiver which uses modulated visible light.

FIG. 2 depicts a transceiver which makes use of modulated visible light. Visible light emanating from light source 9 is transmitted through light modulator 12 which imparts a characteristic intensity modulation and is projected along optical axis 16 to distant surface 17 by means of lens 14. The projected pattern 18 is largely within the field-of-view of the receiver designated at surface 17 by subtending area 20. Light reflected from this area is accepted along optical axis 15 through receiver lens 13 and focused onto detector 11 which delivers detection signals to processing and annunciation electronics 10. Inasmuch as the nominally parallel optical axes 16 and 15 are in close lateral proximity and the distance to a candidate projection surface is at least several feet, the area of light pattern overlap 19 is almost equal to the entire projected beam area. Each transceiver can detect light from other transceivers and avoid detecting light projected from its own transmitter by responding only to the light modulation characteristic of the other transceivers.

Figure 3A:
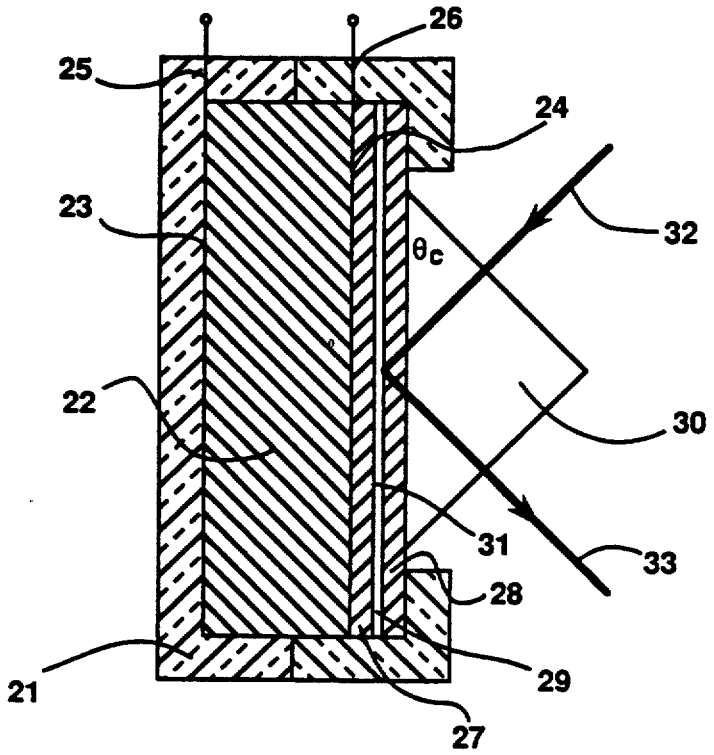
FIG. 3*a* is a schematic of a reflection mode visible light modulator.
Figure 3B:
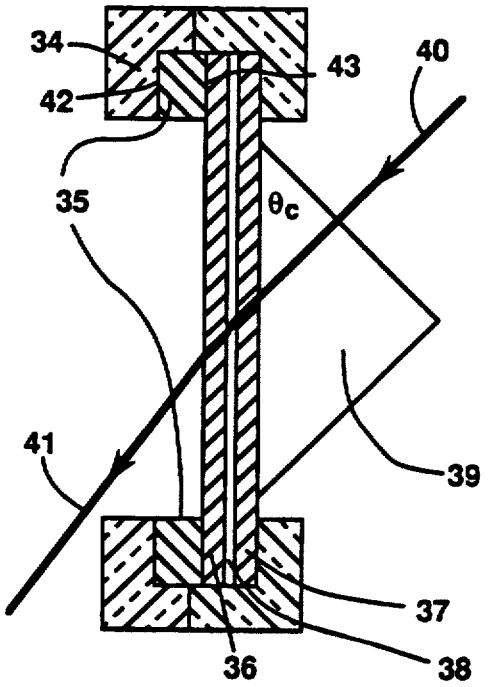
FIG. 3*b* is a schematic of a transmission mode visible light modulator.

As projected light patterns are swept across the distant surface the encounter times (aperture times) of two overlapping projected images can be as little as a millisecond consequently, the modulation of the light beams must occur at ultrasonic frequencies for reliable detection. FIG. 3*a* and FIG. 3*b* provide schematic diagrams of versions of a total internal reflection modulator capable of producing significant intensity modulation depth for visible light at ultrasonic frequencies. FIG. 3*a* shows the device configuration for the reflection mode of operation. It comprises a retainer assembly 21, a disc of piezoceramic material 22 having electroded surfaces 23 and 24 with electrical connections 25 and 26, respectively, a pair of thin plates 27 and 28 separated by an air gap 29 and made from glass or plastic with plate 27 having a mirrored surface 31 and plates 28 having a prism 30 transparently adhered. During operation an incoherent, collimated, visible light beam 32 is incident normal to the surface of the prism 30, is transmitted through the prism 30 and plate 28 so as to be incident at the interface of plate 28 and the air gap 29 at the critical angle and then is subject to total internal reflection. As a result an evanescent light wave exists at this interface. Increasing amounts of energy from this wave can be made to reflect from the mirrored surface 31 and couple back into plate 28 by reducing the air gap 29 between the two plates 27 and 28 from a distance of 1 micron to a distance of about 0.25 microns (a fraction of the mid-visible wavelength). This is achieved by electrostriction (electrically induced expansion) of the piezoceramic disc 22 under the influence of a voltage applied to the electrodes 23 and 24. An alternating applied voltage will modulate the intensity of the light reflected back into plate 28 and coupled out of the device as beam 33. The static air gap 29 is of so small a thickness that it may be created by either the nominal non-compliance of the two plates 27 and 28 in contact or by use of thin film spacers deposited at the edge of these plates. FIG. 3*b* show the corresponding device configuration for the transmission mode of operation. A retainer assembly 34 captivates a piezoceramic ring 35 and thin transparent plates 36 and 37 separated by air gap 38. A prism 39 is attached to plate 37 for efficient input coupling of light as in FIG. 3*a*. Piezoceramic ring 35 has electrodes 42 and 43. Incoherent, collimated visible light beam 40 is introduced through prism 39 and is incident at the interface of plate 37 with air gap 38 at the critical angle. The electrostriction of piezoceramic ring 35 modulates the air gap thickness and hence the amount of light transmitted into plate 36 and out of the device as beam 41.

Figure 4:
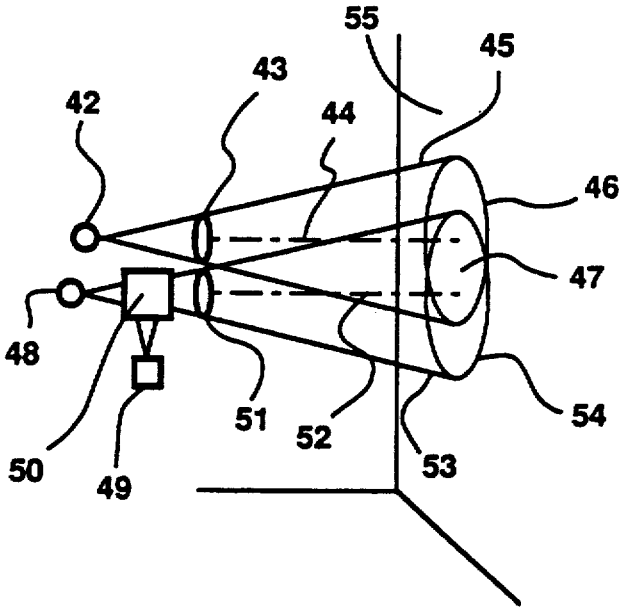
FIG. 4 is an embodiment of a transceiver which coprojects visible light and modulated infrared light.

FIG. 4 depicts a transceiver which uses modulated infrared light coprojected with the visible light. Unmodulated visible light is projected by lens 43 along optical axis 44 to form a pattern 46 on distant surface 55. The optical axis 52 which is parallel to optical axis 44 serves as either a transmit or receive path depending on the state of optical switch 50. Lens 51 establishes the optical path 53 and beam pattern 54. The optical switch 50 will either allow light reflected from the region of beam footprint 54 on the distant surface to be received at detector 49 or modulated infrared light from light emitting diode 48 to be projected to the region of pattern 54.

The state of this switch will, depending upon convention, allow the transceiver to be used either in pursuit mode (when the goal is to overlap the projected pattern of another transceiver) or escape mode (when the goal is to avoid overlap by the pattern projected by another transceiver). The modulation frequency of the infrared light is characteristic of a particular transceiver so that detection of another transceiver's modulation frequency is indicative of pattern overlap. As in FIG. 2 the area of overlap 47 is a large percentage of the projected light pattern area.

Figure 5A:
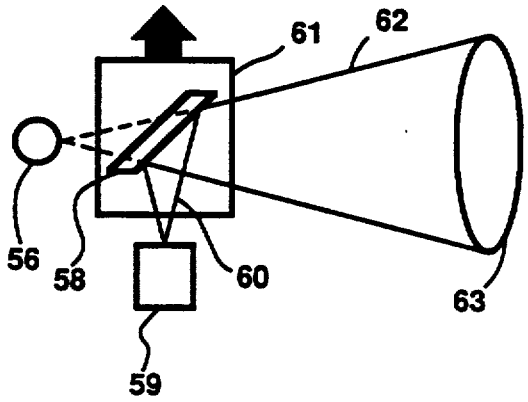
FIG. 5*a* depicts an optical switch achieved by mirror translation.
Figure 5B:
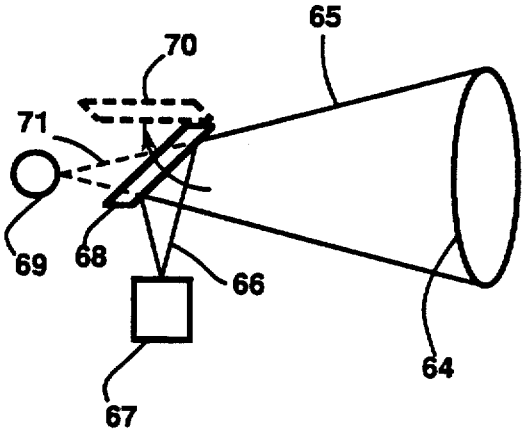
FIG. 5*b* depicts an optical switch achieved by mirror rotation.
Figure 5C:
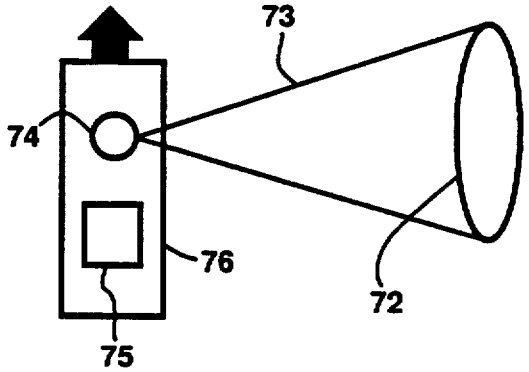
FIG. 5*c* depicts an optical switch achieved by detector translation.

FIG. 5 shows various ways to achieve the function of the optical switch of FIG. 4. In FIG. 5*a* the transceiver focusing element, lens 63, establishes optical beam path 62. A small mirror 58 is mounted on a slide switch platform 61. In the position shown the mirror 58 intercepts received energy along beam path 62 and directs it along path 60 to detector 59. When slide switch platform 61 is translated in the direction of the arrow, light-emitting-diode 56 has an unobstructed projection path 57. In FIG. 5*b* transceiver focusing element, lens 64, establishes beam path 65. Mirror 68 is provided with rotational means so that in one position it may intercept received light along path 65 and reflect it along path 66 to detector 67. In another position 70 it may allow transmission of light from light-emitting-diode 69 along paths 71 and 65. FIG. 5*c* shows transceiver focusing element, lens 72, establishing beam path 73. Both light-emitting-diode 74 and detector 75 are mounted on slide switch platform 76 so that either device may be positioned in beam path 73.

Figure 6:
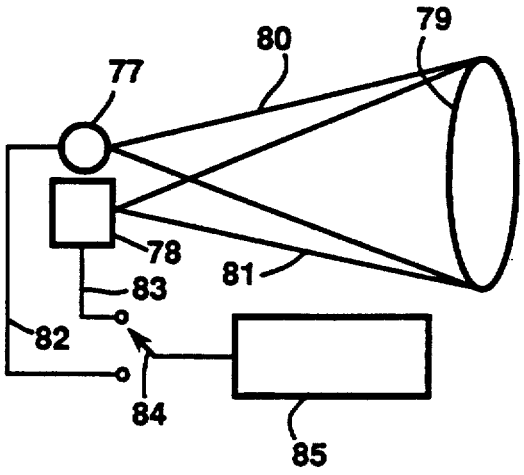
FIG. 6 depicts an optical switch achieved by electrical switching of light-emitting and detecting devices.

The optical switch function of FIG. 4 may be replaced with the purely electrical switching function depicted in FIG. 6. In FIG. 6 the light-emitting-diode 77 and detector 78 are placed in such close proximity that their respective transmit and receive beam paths 80 and 81 substantially overlap and are within the acceptance angle of lens 79. Electrical switch 84 may then be used to switch the respective electrical device connections 82 and 83 to the transceiver 85. In the transceiver embodiment which uses only visible light, a player-selectable mode switch on the transceiver will turn the receiver either on or off. In the alternate transceiver embodiment, a player-selectable mode switch will select between transmission and reception of modulated infrared light (i.e., this mode switch comprises the aforementioned optical switch 50 and/or electrical switch 84). Analogous to the traditional children's game of tag in which one of a group of players is selected to be "it" and seeks to escape the pursuit of the remaining players, a convention can be established wherein one of the player-selectable modes is associated with pursuit and the other mode is associated with escape. This implies that at any given time at least one transceiver must be operating in the pursuit mode and one transceiver must be operating in the escape mode. More sophisticated versions of mode selection entail automatic means; switching between modes at random times can be caused by control internal to each transceiver. Additionally, processing internal to each transceiver can cause the selection of the appropriate mode when image overlap is detected.

Upon detection of image overlap, the electronics within the transceivers involved can also annunciate the tag by the illumination of externally mounted light-emitting-diodes (LED's) and the generation of sound. Additionally, electronic counters can keep track of score and provide output to either a sequence of LED's or an alphanumeric display.

Figure 7:
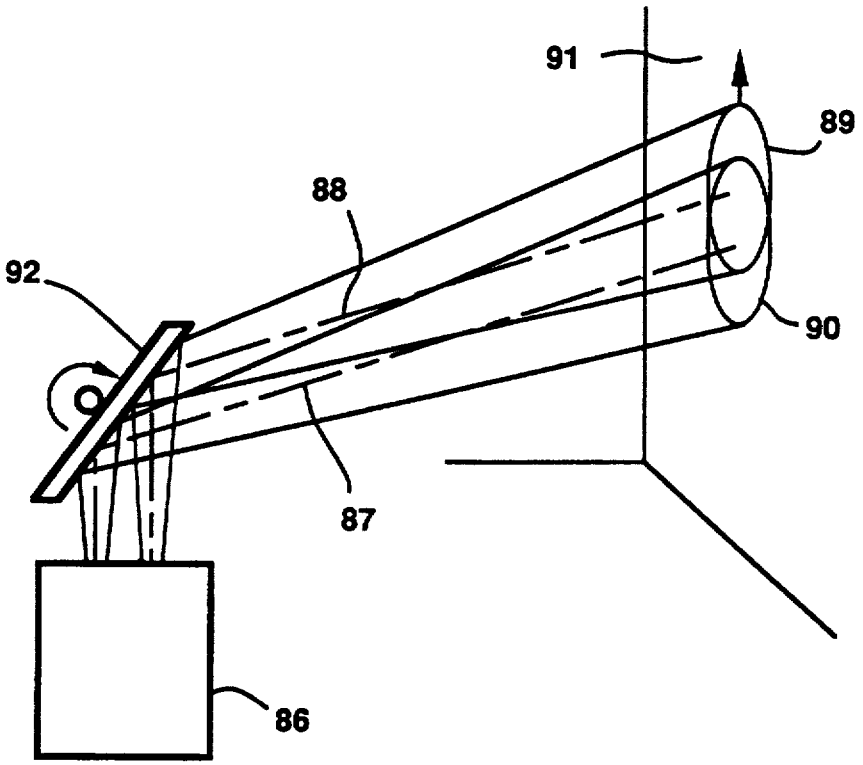
FIG. 7 is a schematic of an automatic transceiver which projects a pattern along a random trajectory.

FIG. 7 depicts an automatic transceiver which projects a pattern along a random trajectory. Transceiver 86 operates along the two optical paths with having optical axes 87 and 88. The projected visible pattern 89 and the region 90 associated with either the infrared transceiver of visible receiver implentation is translated along distant surface 91 by two-axis steering mirror 92.

Figure 8:
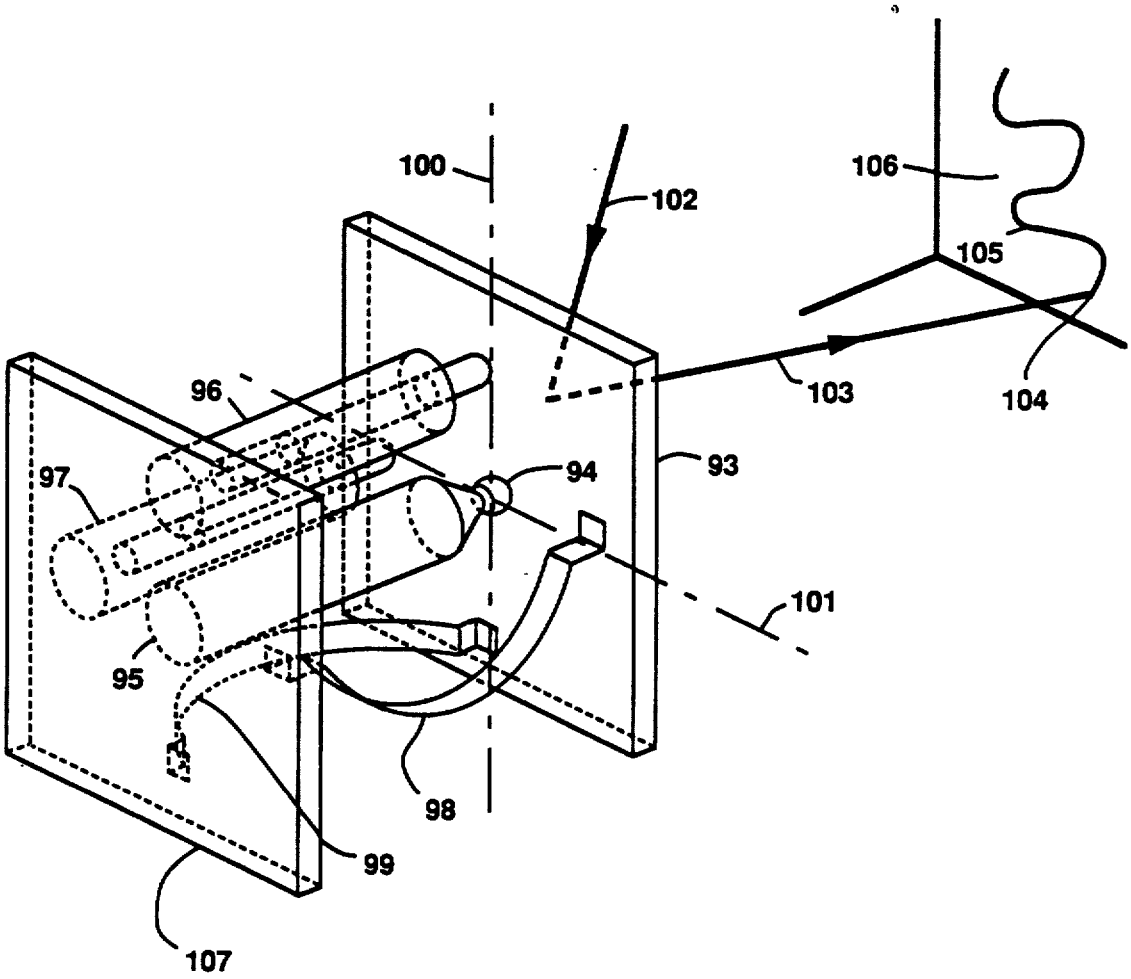
FIG. 8 is a schematic of a two-axis steering mirror employed in the automatic transceiver of FIG. 7.

FIG. 8 shows a simple reduction to practice of the two axis steering mirror employed in FIG. 7. Mirror 93 is allowed to pivot about a ball-in-socket mount 94 at the end of a rod 95 attached to supporting backplate 107. Tilt of mirror 93 about horizontal and vertical axes 101 and 100, respectively, is induced by the linear stroke of the core of solenoid actuators 96 and 97 also mounted to backplate 107. Spring tensioners 98 and 99 provide backpressure on the cores of solenoid actuators 96 and 97 so as to maintain them in contact with mirror 93. Alternatively, the use of spring tensioners may be avoided by providing ball-in-socket connections of each actuator to the mirror. Random actuating voltages applied to actuators 96 and 97 cause the projected pattern 104 to transverse a random trajectory 105 on distant surface 106.

Figure 9:
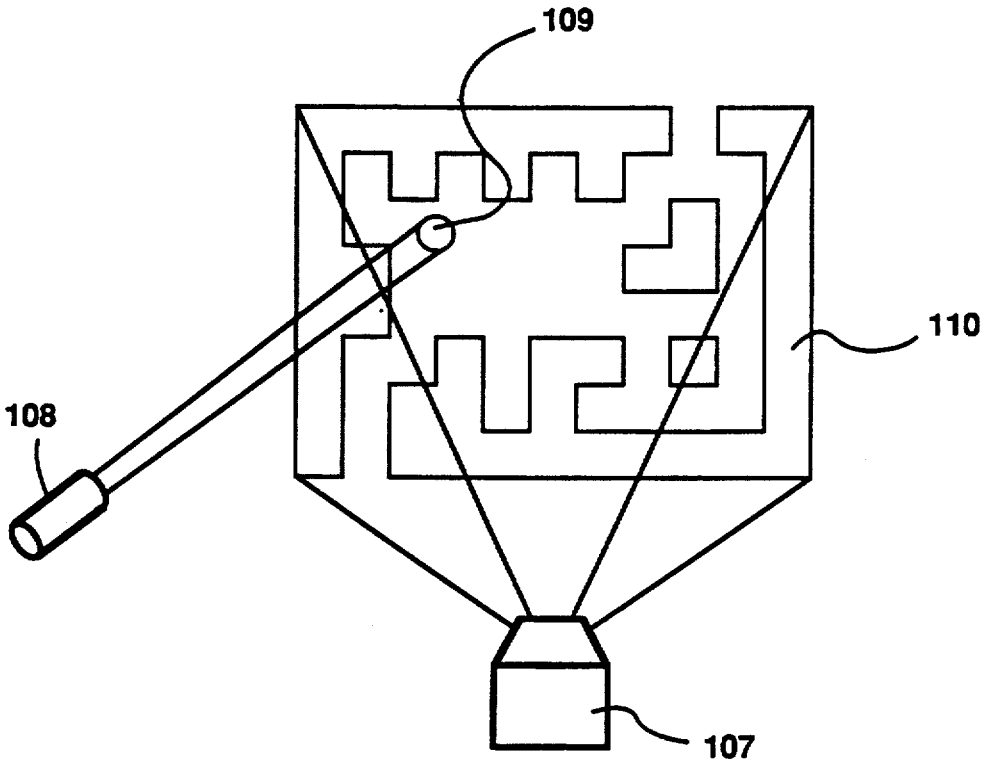
FIG. 9 is a pictorial depiction of a transceiver system which includes the projection of a maze pattern.

FIG. 9 depicts a transceiver 107 which projects the image of a maze pattern 110. Transceiver 108 projects an object pattern 109 which traverses the maze by player control. Either transceiver 107 or 108 can detect the overlap of patterns 109 and 110 and hence violation of the maze boundaries.

What is claimed is:

1. A system for the projection of light patterns from separate sources onto distant surfaces and the detection of spatial and temporal coincidence of said light patterns on said distant surfaces, said system comprising a multiplicity of transceiver devices, said transceiver device further comprising;

(a) an intensity modulated, visible light-emitting device with said modulation characteristic of particular said transceiver device;

(b) light collecting, image forming and focusing means incident to light emanated from said visible light emitting device for projecting a visible light pattern on a distant surface along a first optical axis;

(c) light collecting, focusing and detector means located along a second optical axis in close proximity and parallel to said first optical axis, with a field-of-view that allows said detector to receive light only from the region of said projected visible light pattern on said distant surface;

(d) electronic means for processing electronic signals resulting from optical detection of said received light, said processing means responsive to said modulation characteristic of other said transceiver devices.

2. A system as claimed in claim 1, wherein said system comprises a multiplicity of handheld transceivers.

3. A system as claimed in claim 1, wherein each said intensity modulated, visible light-emitting device is modulated at a frequency sufficient to allow reliable detection by said detector means in millisecond durations of the overlap of said visible light patterns projected onto said distant surfaces by different said transceivers.

4. A system as claimed in claim 1, wherein said surfaces comprise arbitrary non-specular surfaces.

5. A system as claimed in claim 1, wherein said system comprises a multiplicity of handheld transceivers and a stationary transceiver, said image forming means of said stationary transceiver containing automatic mechanical means for causing said projected visible image to traverse random trajectories on said distant surface.

6. A system as claimed in claim 1, wherein said electronic means further contain annunciation means responding to the detection of said modulated light characteristic of other said transceiver devices.

7. A system as claimed in claim 1, wherein said system comprises a multiplicity of handheld transceivers and a stationary transceiver, said image forming means of said stationary transceiver having provision for projecting an image of a maze pattern on said distant surface.

8. A system for the projection of light patterns from separate sources onto distant surfaces and the detection of spatial and temporal coincidence of said light patterns on said distant surfaces, said system comprising a multiplicity of transceiver devices, each said transceiver device further comprising;

(a) a visible light emitting device;

(b) light collecting and focusing means incident to light emanated from said visible light emitting device for projecting a visible light pattern on a distant surface along a first optical axis;

(c) an infrared transmitter and receiver assembly with means for projecting onto said physical surface along a second optical axis a modulated infrared light pattern and receiving modulated infrared light reflected from said surface along said second optical axis, said infrared transmitter and receiver assembly having means for switching its function to either transmitter or receiver, said second optical axis parallel and proximate to said first optical axis whereby said projected modulated infrared light pattern largely overlaps said projected visible light pattern on said surface, region of said projected visible and infrared light patterns subtending the angular field-of-view of said infrared receiver, said infrared receiver further comprising a detector and electronic means for processing electronic signals resulting from detection of said modulated infrared light reflected from region of said visible light pattern on said surface, said processing means responsive to said modulation characteristic of other said transceiver devices.

9. A system as claimed in claim 8, wherein said system comprises a multiplicity of handheld transceivers.

10. A system as claimed in claim 8, wherein each said modulated infrared light pattern is modulated at a frequency sufficient to allow reliable detection by said detector means in millisecond durations of the overlap of said visible (and coprojected infrared) light patterns projected onto said distant surfaces by different said transceivers.

11. A system as claimed in claim 8, wherein said surfaces comprise arbitrary non-specular surfaces.

12. A system as claimed in claim 8, wherein said system comprises a multiplicity of handheld transceivers and a stationary transceiver, said image forming means of said stationary transceiver containing automatic mechanical means for causing said projected visible (and infrared) image to traverse random trajectories on said distant surface.

13. A system as claimed in claim 8, wherein said electronic means further contain annunciation means responding to the detection of said modulated light characteristic of other said transceiver devices.

14. A system as claimed in claim 8, wherein said system comprises a multiplicity of handheld transceivers and a stationary transceiver, said image forming means of said stationary transceiver having provision for projecting a visible and spatially coicident infrared image of a maze pattern on said distant surface.

15. A method for both projecting visible light patterns and detecting the spatial and temporal coincidence of said visible light patterns projected onto arbitrary surfaces by different sources, said method comprising:

(a) projecting a multiplicity of light pattern pairs onto an arbitrary surface, each said light pattern pair projected from an independent position and aribitrary direction, projecting of a single said light pattern pair (an infrared and visible image) from one of said independent positions further comprising:

(i) projecting a visible light pattern, in a said arbitrary direction, along a first optical axis, to said arbitary surface;

(ii) modulating an infrared light source with a characteristic modulation of sufficient frequency for reliable detection of said modulation in millisecond timeframe;

(iii) projecting said modulated infrared light along a second optical axis proximate and parallel to said first optical axis such that said projected infrared light largely overlaps said visible light pattern on said arbitrary surface;

(b) switching off infrared transmission at one of said independent positions and instead, receiving at said independent position, along said second optical axis with a field of view matched to the visible light pattern projected along said first optical axis, modulate infrared light from other said light pattern pairs, reflected from said arbitrary surface, at such time as desired to detect the overlap on said arbitrary surface of other said light pattern pairs with the visible component of the light pattern pair which remains projected from present said independent position;

(c) detecting, optically, said received infrared light and processing electronically the resulting electronic signal so as to respond to modulation characteristic of the infrared light of another said light pattern pair.

* * * * *